US007963201B2

(12) United States Patent
Willoughby et al.

(10) Patent No.: US 7,963,201 B2
(45) Date of Patent: Jun. 21, 2011

(54) MEDICATION DISPENSING METHOD AND APPARATUS

(75) Inventors: Christopher Wallace Willoughby, Mountain Brook, AL (US); David Walter Wright, Littleton, CO (US); Lee William Travis, Littleton, CO (US); Jeffrey Clyne Garland, Littleton, CO (US)

(73) Assignee: Concept Medical Technologies, Inc., Birmingham, AL (US)

( * ) Notice: Subject to any disclaimer, the term of this patent is extended or adjusted under 35 U.S.C. 154(b) by 526 days.

(21) Appl. No.: 10/857,088

(22) Filed: May 28, 2004

(65) Prior Publication Data

US 2005/0049747 A1 Mar. 3, 2005

Related U.S. Application Data

(63) Continuation-in-part of application No. 10/696,698, filed on Oct. 29, 2003, now Pat. No. 7,264,136.

(60) Provisional application No. 60/497,843, filed on Aug. 26, 2003.

(51) Int. Cl.
*B26D 5/20* (2006.01)
*G07F 11/66* (2006.01)

(52) U.S. Cl. ..... 83/210; 83/233; 83/367; 83/588; 83/629; 83/649; 117/106; 399/333; 225/94; 221/25

(58) Field of Classification Search ..... 221/25, 221/3, 13, 15, 8, 7, 2; 117/106; 83/210, 83/233, 367, 588, 629, 649; 399/333; 225/94
See application file for complete search history.

(56) References Cited

U.S. PATENT DOCUMENTS

| | | | | | |
|---|---|---|---|---|---|
| 1,865,392 | A | * | 6/1932 | Hutchinson et al. | 451/52 |
| 2,220,909 | A | * | 11/1940 | Kershaw | 313/331 |
| 2,518,846 | A | * | 8/1950 | Wright | 160/178.1 R |
| 2,620,513 | A | * | 12/1952 | Cryor et al. | 264/119 |
| 3,362,848 | A | * | 1/1968 | Hamilton | 427/70 |
| 3,566,732 | A | * | 3/1971 | Hasten et al. | 83/205 |
| 3,881,645 | A | * | 5/1975 | Kopp | 225/94 |
| 3,984,030 | A | * | 10/1976 | Morini | 221/30 |
| 3,985,264 | A | * | 10/1976 | Shaw et al. | 221/7 |
| 4,015,703 | A | * | 4/1977 | Keller | 198/624 |
| 4,274,550 | A | * | 6/1981 | Feldstein | 221/71 |
| 4,527,722 | A | * | 7/1985 | Strachan | 225/106 |
| 4,851,075 | A | * | 7/1989 | Parker | 156/556 |
| 5,076,555 | A | * | 12/1991 | Bunch, Jr. | 270/39.05 |
| 5,383,656 | A | * | 1/1995 | Mandel et al. | 271/258.01 |
| 5,400,699 | A | * | 3/1995 | Cailbault | 99/357 |
| 5,522,525 | A | * | 6/1996 | McLaughlin et al. | 221/4 |
| 5,630,347 | A | * | 5/1997 | Elvio | 83/210 |
| 5,695,105 | A | * | 12/1997 | Ohara | 225/96 |

(Continued)

FOREIGN PATENT DOCUMENTS

JP 8215747 8/1996

(Continued)

*Primary Examiner* — Gene O. Crawford
*Assistant Examiner* — Rakesh Kumar
(74) *Attorney, Agent, or Firm* — John D. Wright; Dickinson Wright PLLC

(57) ABSTRACT

A method and apparatus for dispensing prepackaged medication packages includes an apparatus having a body with an internal cavity and an opening. A central processing unit operably communicates with an actuator within the cavity to regulate and monitor the dispensation of the packages, while the actuator operably communicates with a feed mechanism within the cavity to dispense the packages.

18 Claims, 10 Drawing Sheets

U.S. PATENT DOCUMENTS 5,803,261 A * 9/1998 Nowakowski et al. ..... 206/466
5,833,122 A * 11/1998 Reid ..... 221/150 HC
5,957,358 A * 9/1999 Getz et al. ..... 225/77
6,181,982 B1 * 1/2001 Yuyama et al. ..... 700/236
6,394,306 B1 * 5/2002 Pawlo et al. ..... 221/2
6,400,923 B1 * 6/2002 Fukuda et al. ..... 399/333
6,601,729 B1 * 8/2003 Papp ..... 221/25
6,726,665 B1 * 4/2004 Embleton et al. ..... 604/290
6,874,612 B1 * 4/2005 Uland ..... 194/212
6,941,948 B2 * 9/2005 Staniforth et al. ..... 128/203.21
6,962,035 B2 * 11/2005 Yamamoto et al. ..... 53/135.1

FOREIGN PATENT DOCUMENTS

JP 11316877 11/1999

* cited by examiner

MEDICATION DISPENSING METHOD AND APPARATUS

REFERENCE TO CO-PENDING APPLICATION

This is a continuation-in-part of U.S. patent application Ser. No. 10/696,698 filed on Oct. 29, 2003 now U.S. Pat. No. 7,264,136 which claims the priority of U.S. Provisional Patent Application Ser. No. 60/497,843, filed on Aug. 26, 2003.

BACKGROUND OF THE INVENTION

1. Field of the Invention

This invention relates generally to methods and apparatus used for dispensing medications.

2. Related Art

Medication compliance is the act of taking medications in a prescribed dosage, during a prescribed window of time at prescribed intervals. There exist medications that when not taken at the prescribed time, are best not taken until the next prescribed interval. Clinicians recognize the need to manage the dosage times to assure a safe and efficacious therapy. Clinicians also recognize the important role provided by caregivers and concerned parties in helping the mildly incompetent and forgetful medication using population in helping manage their drug therapy.

Some devices attempt to assist patients with their medication compliance. The devices include medication dispensing machines having loadable disposable cups or loadable reservoirs. In all cases, the patient or caregiver loads the individual cups or reservoirs having the medications therein that are to be dispensed for a prescribed dosage. The patient or caregiver typically programs the medication dispensing interval so that the medication is dispensed at the prescribed time. The patient or caregiver often finds the process of loading and programming the machine to be complicated.

Some dispensing machines retain the medications during the prescribed time until the patient manually requests the dispensing of the medications. This is achieved by requiring the patient to manually interact with the machine to obtain the medications. If the patient fails to request the medications, the medications may be dispensed to a quarantine chamber within the machine. The following medication dispensing interval proceeds as manually commanded by the patient. It is also known to include a caregiver notification system which calls a caregiver to notify them of a missed medication event.

Some methods attempt to assist patients with their medication compliance by providing prepackaged medications. Prepackaged medications are available from licensed pharmacies in individually labeled packages. These packages may be labeled with critical information in the form of text regarding the patient, contents, date and time of dosage. Packages may be attached in a sequential fashion allowing the patient to manually remove a single package containing prescribed doses of medication at a specified time. Utilizing a central point of packaging allows for drug interaction screening and multiple drug dosage control by a licensed pharmacist.

SUMMARY OF THE INVENTION

An apparatus is provided for dispensing prepackaged medication. The apparatus includes a plurality of bodies each having an internal cavity and an outlet with an actuator being received in each of the cavities. A feed mechanism is received in each of the cavities, wherein the feed mechanisms are in operable communication with an associated one of the actuators for feeding and dispensing the packages of medication toward the outlet. A processing unit is arranged in operable communication with each of the actuators to regulate the dispensation of the packages by the feed mechanisms through each outlet.

Another aspect of the invention includes a method of dispensing packages of medication to an authorized recipient. The method includes providing a plurality of medication dispensing apparatus and forming a network by arranging the apparatus in communication with one another. Additionally, incorporating a processing unit in the network and incorporating an interface device in communication with the processing unit. Further, providing packages containing predetermined doses medication and loading the packages into the medication dispensing apparatus. Next, entering a request for medication into the interface device and processing the request though the processing unit. Next, making a package from a selected medication dispensing apparatus accessible to the recipient in accordance with the specified request.

Some of the objects, features and advantages of this invention include a method and apparatus for dispensing medication that provides a plurality of medication dispensing apparatus networked to one another, allows packages of medication to be dispensed by a licensed pharmacist to an authorized recipient at a remote location, reduces the time necessary to obtain medication, provides an ability to receive a plurality of medication types and quantities from a single location remote from a licensed pharmacist in an efficient manner, reduces the potential downtime of a person obtaining medication, is easy to use and is economical in manufacture and installation.

BRIEF DESCRIPTION OF THE DRAWINGS

These and other objects, features and advantages will become apparent in view of the following detailed description of the presently preferred embodiments and best mode, and accompanying drawings, in which.

DETAILED DESCRIPTION OF THE PREFERRED EMBODIMENTS

Figure 1:
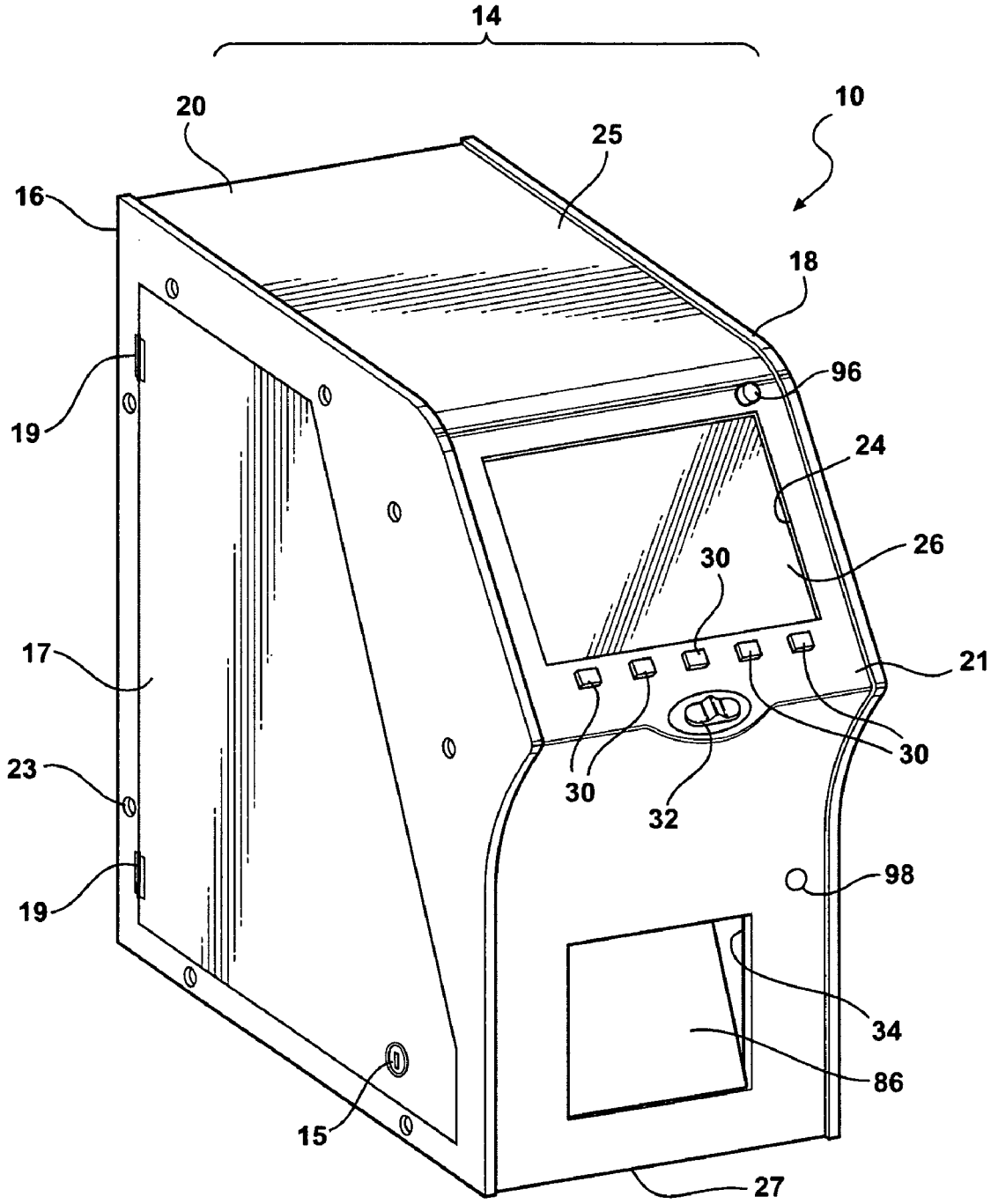
FIG. 1 is a perspective view of a medication dispensing apparatus constructed according to one presently preferred embodiment of the invention.
Figure 2:
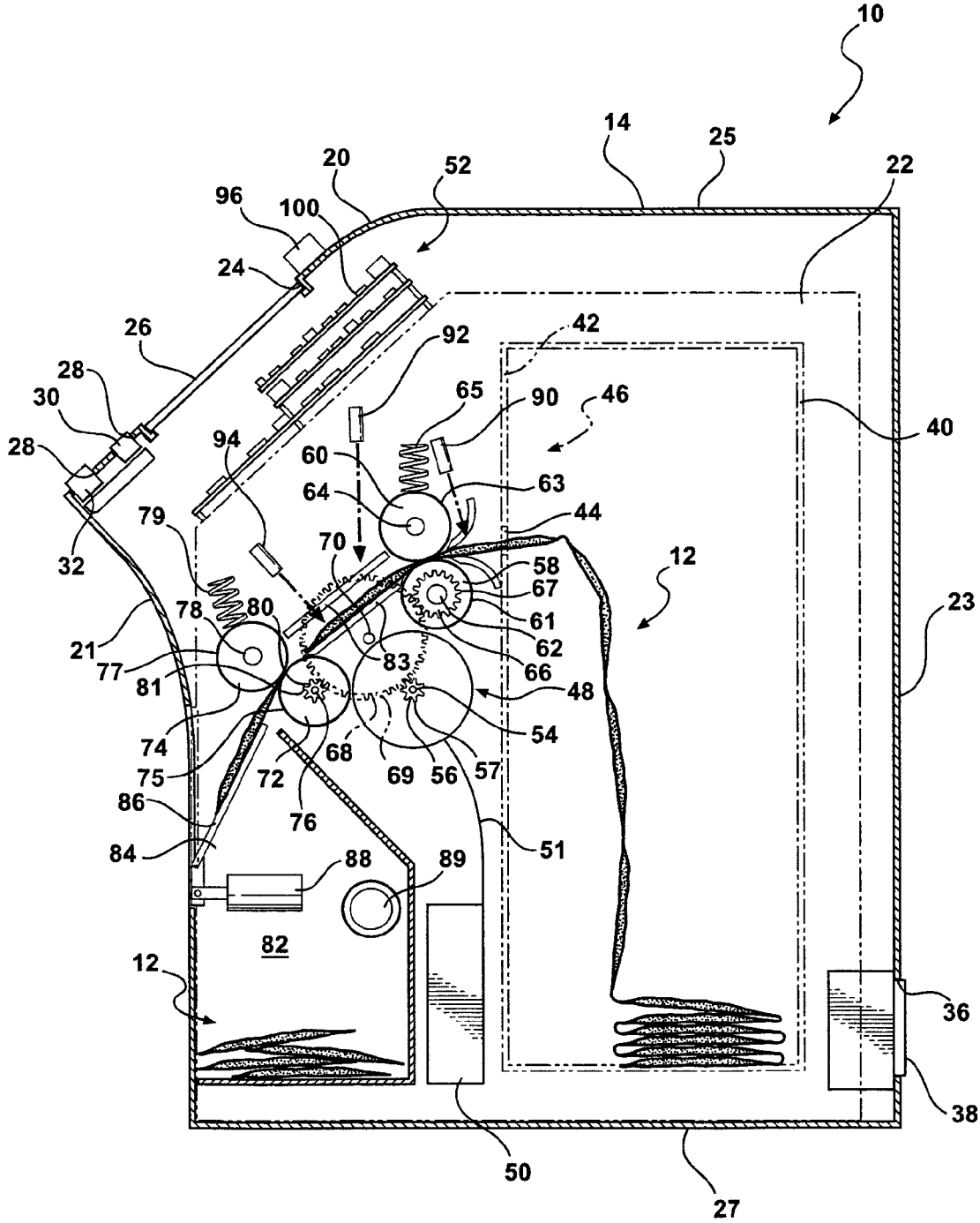
FIG. 2 is a side view of the apparatus with a side plate removed showing an interior cavity and a plurality of internal components therein.

FIGS. 1 and 2 illustrate a medication dispensing machine or apparatus 10 that provides a patient or caregiver to the patient an ability to dispense medications in prescribed dosages and during prescribed intervals of time. The medications are contained in prepackaged and labeled packages 12 to provide the patient with the proper dosage of medications at a prescribed time. The apparatus 10 allows the dispensation of medication to be monitored and controlled so that the patient, caregiver, or any other person having access, either directly or remotely, to the apparatus 10 can be assured that the patient is taking the medication as prescribed. Additionally, the apparatus 10 can notify the patient, or others, when it is time for the patient to take medication, and if the medication has not been taken within a predefined window of time.

The apparatus 10 has a body 14 preferably having a pair of side walls 16, 18 attached to a housing 20 having front and rear panels 21, 23 and top and bottom surfaces 25, 27 to define an internal cavity 22 (FIG. 2). One of the side walls, shown here as the side wall 16 has a door or access panel 17 arranged for pivotal movement about a set of hinges 19 so that an authorized person can gain access to the inside of the apparatus 10. Preferably, the access panel has a lock 15 to prevent unauthorized persons from gaining access to the inside of the apparatus 10. It should be recognized that the body 14 may be constructed from any suitable material, for example plastic or metallic materials, and further, that any suitable method of construction may be used to fabricate the body 14, for example injection molding, stamping, machining, and the like.

The housing 20 may be constructed as a single piece of material, or otherwise constructed from two or more pieces of material attached to one another. The front panel 21 has an opening 24 for receiving an interface screen 26 and a plurality of smaller openings 28 (FIGS. 6-8) for receiving "soft" or interfacing keys 30 and a dispensing actuator, represented in one form as a button 32 having a pictorial representation of a pill thereon (FIG. 1). The dispensing actuator 32 may be a finger or thumb print recognition pad 32 to restrict dispensation of the packages 12 to a person having proper authorization. The finger or thumb print information of the authorized people may be programmed into the apparatus 10, as necessary. In addition, the dispensing actuator 32 may be a voice recognition microphone, eye or retina scanning mechanism, or other recognition system that would restrict dispensation of the packages 12 to authorized individuals having the requisite identification features to trigger dispensation of the packages 12 from the apparatus 10. Each interface key 30 is able to effectively change definition and control a variety of functions, depending on the mode selected by the user, as discussed in more detail hereafter. The front panel 21 also has an opening 34 through which the individual packages 12 are dispensed at their individually specified or prescribed times. Desirably, the rear panel 23 has an opening 36 through which a power module 38 may be accessed.

Figure 4:
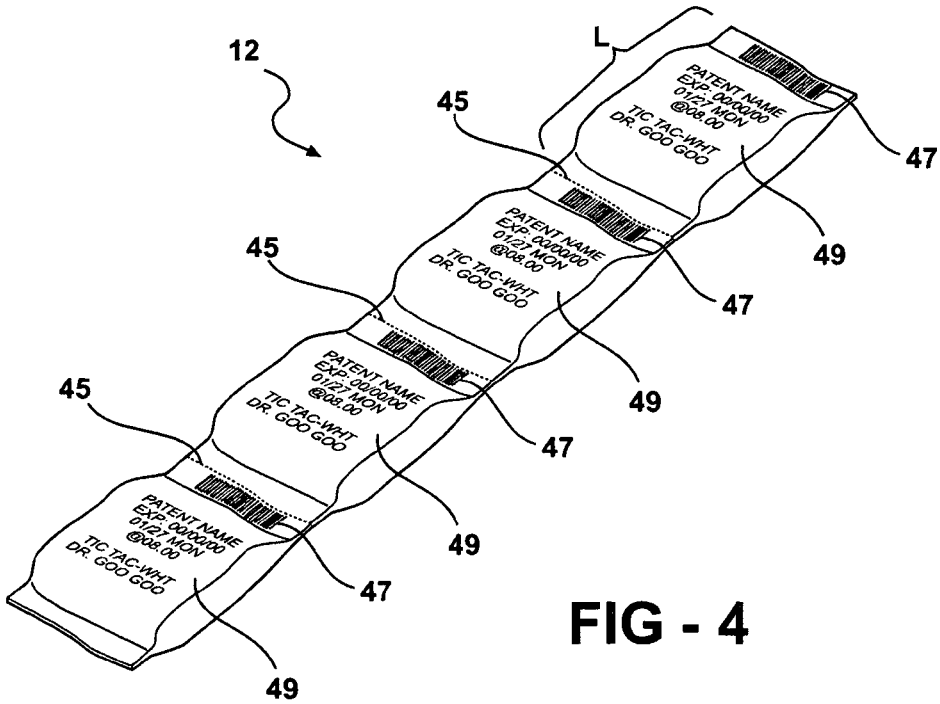
FIG. 4 is a partial perspective view of one form of prepackaged doses of medication.

As shown in FIG. 2, the apparatus 10 accommodates a container 40 sized for receipt in the cavity 22 of the body 14. The container is preferably generally rectangular in shape and is sized to accommodate a plurality of packages 12. In one embodiment, as shown in FIG. 4, the packages 12 adjacent one another are joined along a perforated seam 45, and are preferably stacked one on top of another, in a folded accordion fashion, within the container 40. It should be recognized that the packages 12 may also be coiled about a spool, or otherwise stored within the container 40. Desirably, the container 40 has a wall 42 with a slot 44 through which the packages 12 of medication pass during advancement of the packages 12. The container 40 preferably can hold a significant supply of medication, for example, a one month supply of medication or more. Preferably, the container is loaded with the packages 12 by a licensed individual, for example a pharmacist. It should be recognized that the container 40 serves to maintain the packages 12 in position so that they can readily unfold or uncoil, for dispensation from the apparatus 10.

As shown in FIG. 4, the packages 12 are preferably individually sealed pouches joined to one another at the perforated seam 45. This provides a string of interconnected packages of medication. As mentioned above, the packages 12 are preferably prepackaged by a licensed pharmacist and labeled, encoded, or otherwise identified to indicate their individual contents. Desirably, a bar code 47 is used to encode all the information, for example, dosage time to be taken, name of patient, types of medication, amount of medication and the like. It should be recognized that in addition to or in place of the bar code 47, preferably the above information is labeled in optically readable text 49, or some other form of readable information, for example symbols or Braille. By having the medication prepackaged, the pharmacist can perform a drug interaction screen to ensure the medications in the package do not have adverse reactions with one another. In addition to the packages 12 being labeled with the patient information described above, specified packages 12 may include information in the form of instructions to facilitate the operation of the apparatus 10. The instructions may take the form of downloadable software to in affect program or initialize a programmable device, represented here by a central processing unit (CPU) 52 within the apparatus 10, for example. The instruction may include set-up information, preferably on a leading package 12, to communicate with the CPU 52 to provide the apparatus 10 with specific operating instructions. It should be recognized that any desired package 12 within the string of packages 12 could include information to facilitate operation of the apparatus 10, thereby changing the mode of operation of the apparatus at predetermined times.

Referring again to FIG. 2, to advance and dispense the packages 12 of medication, the apparatus 10 has a feed mechanism represented generally at 46. The feed mechanism 46 has, in part, an actuator, represented here by example as an electric motor 48. The motor 48 is operably connected to a controller 50, such as by a wire connection 51, for example, wherein the controller 50 is in operable communication with the CPU 52, for example, by a wire connection (not shown). The motor 48 has a shaft 54 with a drive member, represented by example as a drive gear 56 having a predetermined number of radially outwardly extending teeth 57. The drive gear 56 is attached to the shaft 54 for conjoint rotation with the shaft 54.

The feed mechanism 46 also has a first pair of rollers, referred to hereafter as a pair of feed rollers 58, 60 having relatively compliant outer surfaces 61, 63 supported for rotation with a pair of generally parallel shafts 62, 64, respectively. The feed rollers 58, 60 are laterally spaced from one another a distance great enough to allow the packages 12 to pass therethrough, but also a distance providing for engagement of the rollers 58, 60 with the packages 12. The compliant outer surfaces 61, 63, for example rubber, silicone, foam, or the like, facilitate feeding the packages 12 between the rollers by creating frictional engagement with the packages 12. At least one of the shafts 62, 64 fixed to the feed rollers 58, 60 may be biased by a spring 65, shown here as shaft 64, to bias the shafts 62, 64 toward or away from one another, thereby allowing the feed rollers 58, 60 to move laterally toward and away from one another while accommodating and engaging the packages 12 as they pass between the feed rollers 58, 60. It should be recognized that the feed rollers 58, 60 may initially engage one another, while moving laterally away from one another as the packages 12 pass between the feed rollers 58, 60.

One of the feed rollers 58 has a driven member, represented here by example as a driven gear 66 attached to the shaft 62 with a predetermined number of teeth 67 extending radially outwardly from the driven gear 66 so that the feed roller 58 rotates about its longitudinal axis in response to rotational movement of the driven gear 66, the drive gear 56 and the motor 48. The other feed roller 60 is desirably arranged to freewheel and rotate in response to the rotational movement of the feed roller 58.

Desirably, the motor 48 is in operable communication with the feed roller 58 through the incorporation of an idler member, represented here by example as an idler gear 68 having a predetermined number of outwardly extending teeth 69 supported for rotation about a shaft 70. The teeth 69 of the idler gear 68 are arranged to mesh with both the teeth 57 of the drive gear 56 and the teeth 67 of the driven gear 66. Accordingly, as the drive gear 56 of the motor 48 rotates, the idler gear 68 rotates, thereby causing the driven gear 66 and the feed roller 58 to rotate.

The feed mechanism 46 also has a pair of dispensing rollers 72, 74 laterally spaced from the feed rollers 58, 60, shown here a having a space greater than a length (L) of a single package 12 (FIG. 4). The dispensing rollers 72, 74 have relatively compliant outer surfaces 75, 77 supported for rotation with a pair of generally parallel shafts 76, 78, respectively. The dispensing rollers 72, 74 are laterally spaced from one another a distance great enough to allow the packages 12 to pass therethrough, but also a distance providing for engagement of the dispensing rollers 72, 74 with the packages 12. The compliant outer surfaces 75, 77 are similar as that to the feed rollers 58, 60, thereby facilitating dispensation of the packages 12 between the dispensing rollers 72, 74. At least one of the shafts 76, 78 fixed to the dispensing rollers 72, 74, shown here as shaft 78, may be biased by a spring 79 to bias the shafts 76, 78 toward or away from one another, thereby allowing the dispensing rollers 72, 74 to move laterally toward and away from one another while accommodating and engaging the packages 12 as they pass between the dispensing rollers 72, 74. It should be recognized that the dispensing rollers 72, 74 may initially engage one another, while moving laterally away from one another as the packages 12 pass between the dispensing rollers 72, 74. It should also be recognized that the feed roller shafts 62, 64 are arranged in a generally parallel orientation relative to the dispensing roller shafts 76, 78.

One of the dispensing rollers 72 has a driven member, represented here by example as a driven gear 80 attached to the shaft 76 with a predetermined number of teeth 81 extending radially outwardly therefrom to mesh with the teeth 69 extending from the idler gear 68. Accordingly, the dispensing roller 72 rotates about its longitudinal axis in response to rotational movement of the motor 48, the idler gear 68 and the driven gear 80. The other dispensing roller 74 is desirably arranged to freewheel and rotate in response to the rotational movement of the dispensing roller 72. Desirably, the driven gear 80 has fewer teeth than the driven gear 66 of the feed roller 58.

With the driven gear 80 having fewer teeth than the driven gear 66, the dispensing rollers 72, 74 are caused to rotate at a slightly greater rotational velocity than the feed rollers 58, 60. Accordingly, as the packages 12 pass between the feed rollers 58, 60 and the dispensing rollers 72, 74, and preferably between a pair of generally transparent support plates 83, the packages 12 are placed in tension between the feed rollers 58, 60 and the dispensing rollers 72, 74. As a result, the packages 12 tear from one another along the preformed perforation 45 between the adjacent packages 12, thereby causing a single package 12 to separate from the remaining string of packages 12 in the cavity 22 of the apparatus 12. The single package 12 is then dispensed through the opening 34 in the housing 20, as discussed in more detail hereafter.

Figure 3:
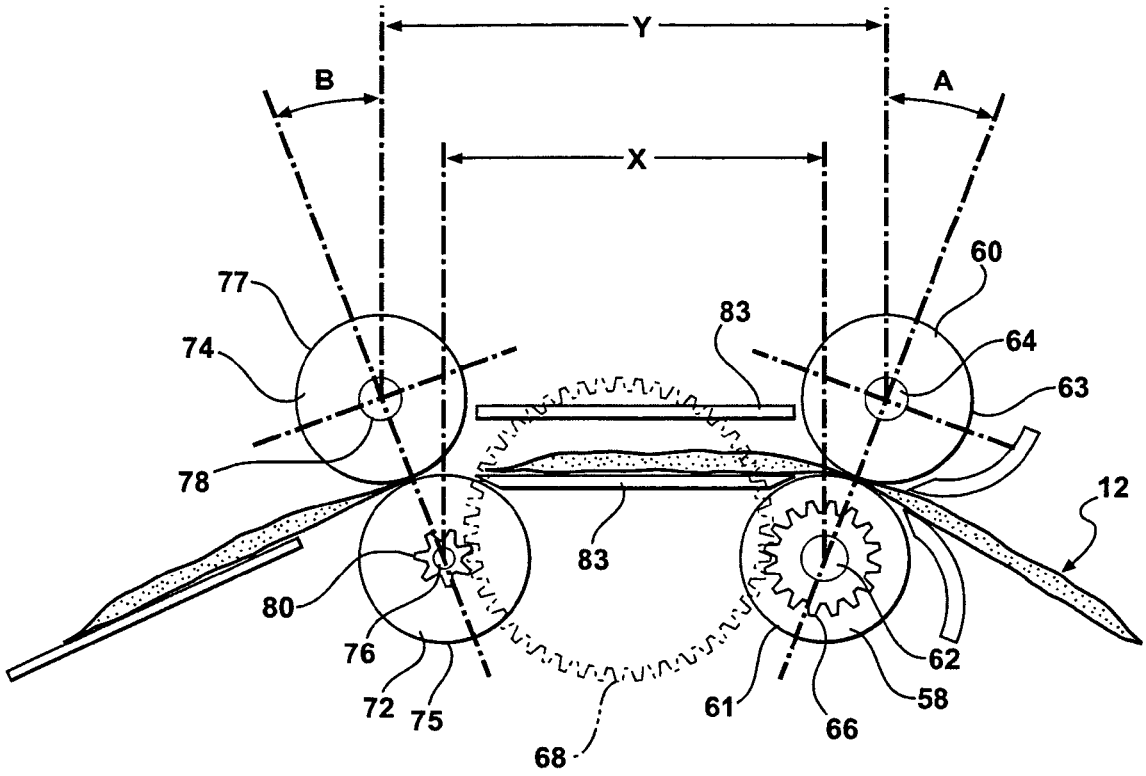
FIG. 3 is a partial side view of a feed mechanism of the apparatus of FIG. 1.

As shown in FIG. 3, to facilitate dispensation of the packages 12 between the feed rollers 58, 60 and the dispensing rollers 72, 74, the shaft 62 of the feed roller 58 and the shaft 76 of the dispensing roller 72 are spaced apart a first distance (X), while the shaft 64 of the feed roller 60 and the shaft 78 of the dispensing roller 74 are spaced apart a second distance (Y), such that the distance (Y) is preferably greater than the distance (X). Accordingly, angles (A) and (B) are defined, with each of the angles (A) and (B) being generally between 0-90 degrees, desirably between 15-45 degrees, and preferably between 25-35 degrees. Having the feed rollers 58, 60 in an angled orientation relative to the dispensing rollers 72, 74 causes the packages 12 to engage one of the feed rollers 58 and one of the dispensing rollers 72 about a portion of their outer surfaces 61, 75, respectively. As a result, an increased frictional engagement of the feed roller 58 and the dispensing roller 72 with the packages 12 occurs as the packages 12 pass between the feed rollers 58, 60 and the dispensing rollers 72, 74.

As shown in FIG. 2, the apparatus 10 has a chamber 82 for capturing packages 12 of medication not taken within a predefined specified time interval. The chamber 82 is located generally beneath the feed mechanism 46 and has an opening 84 positioned directly beneath the dispensing rollers 72, 74. A lid 86 acting both as a top to the chamber 82 and, at least in part, as a dispensing chute for the packages 12 is arranged for pivotal movement between a closed and open position. When the lid 86 is in the closed position, the lid 86 covers the opening 84 so that the packages 12 dispensed from the dispensing rollers 72, 74 land on top of the lid 86 and slide through the opening 34. However, when the lid 86 is in the open position, the lid 86 obstructs the opening 34 and uncovers the opening 84 to the chamber 82 so that packages 12 dispensed between the dispensing rollers 72, 74 fall into the chamber 82. Upon the package 12 falling into the chamber 82, the lid 86 returns to its closed position, and the package remains in the chamber 82 until a person having authorization can access the chamber 82. To facilitate movement of the lid 86, an actuator, such as a solenoid 88 for example, moves between a retracted position and an extended position to open and close the lid, respectively.

To initiate movement of the actuator 88 between its extended and retracted positions, the actuator 88 is operably connected to the CPU 52. The CPU 52 is programmed to send a signal to the solenoid 88 to actuate the solenoid 88 to its retracted position when the patient or caregiver fails to press the dispensing button 32 within a predefined time interval from the specified time at which the medication is to be taken. Accordingly, as a result of the failure of the patient or caregiver to press the dispensing button 32, the lid 86 is moved to its open position via the signal sent to the solenoid 88 by the CPU 52, while the CPU 52 concurrently sends a signal to the controller 50 to actuate the motor 48. Accordingly, the feed mechanism 46 feeds the package 12 that was not taken within the predefined time interval so that the package 12 is automatically fed by the apparatus 10, and ultimately the package 12 not taken passes through opening 84 and into the chamber 82. Thereafter, the CPU 52 deactivates the motor 48 and the solenoid 88, thereby returning the lid 86 to its closed position. Any packages 12 dispensed into the chamber 82 are maintained or locked within the chamber 82 until a person having access to the chamber 82, such as through the use of a proper key to unlock a lock cylinder 89, accesses the chamber 82 to retrieve the packages 12 of medication not taken by the patient.

To facilitate loading the packages 12 into the feed mechanism 46, a detection device or first sensor 90 arranged for communication with the CPU 52 is arranged generally between the container 40 and the feed rollers 58, 60. Accordingly, as the user feeds the first package 12 in a string of packages 12 into engagement with the feed rollers 58, 60, the sensor 90 sends a signal to the CPU 52, wherein the CPU 52 energizes the motor 48. The motor 48 then causes the feed rollers 58, 60 to rotate to advance the packages between the feed rollers 58, 60 and toward the dispensing rollers 72, 74. The sensor 90 could be supplemented or replaced with a button so that the user can manually load the packages 12 into the feed mechanism 46 by depressing the button to actuate the motor 48. As the first package 12 advances toward the dispensing rollers 72, 74, a reading device or second sensor 92, for example an optical character recognition (OCR) device, an optical bar code scanner, or the like, is in operable communication with the CPU 52 and reads or detects information on the package 12, for example, the text 49, the bar code 47 or any other information, for example symbols, to relay the information to the CPU 52. As the package 12 continues toward the dispensing rollers 72, 74, the package 12 encounters a pre-tear sensor or third sensor 94 also in operable communication with the CPU 52. The pre-tear sensor 94 sends a signal to the CPU 52, wherein the CPU 52 sends a signal to the motor 48 to de-energize the motor 48, thereby stopping the advancement of the packages 12 prior to the dispensing rollers 72, 74. The packages 12 remain in this position until the prescribed dosage time, previously communicated to the CPU 52, arrives. Upon the arrival of the prescribed dosage time, the CPU 52 energizes the motor 48 to start the feed process of the packages 12 to either dispense the package 12 to a user, or to dispense the package 12 into the chamber 82 for containment until an authorized person accesses the chamber 82 to remove the unused package 12 of medication.

Figure 5:
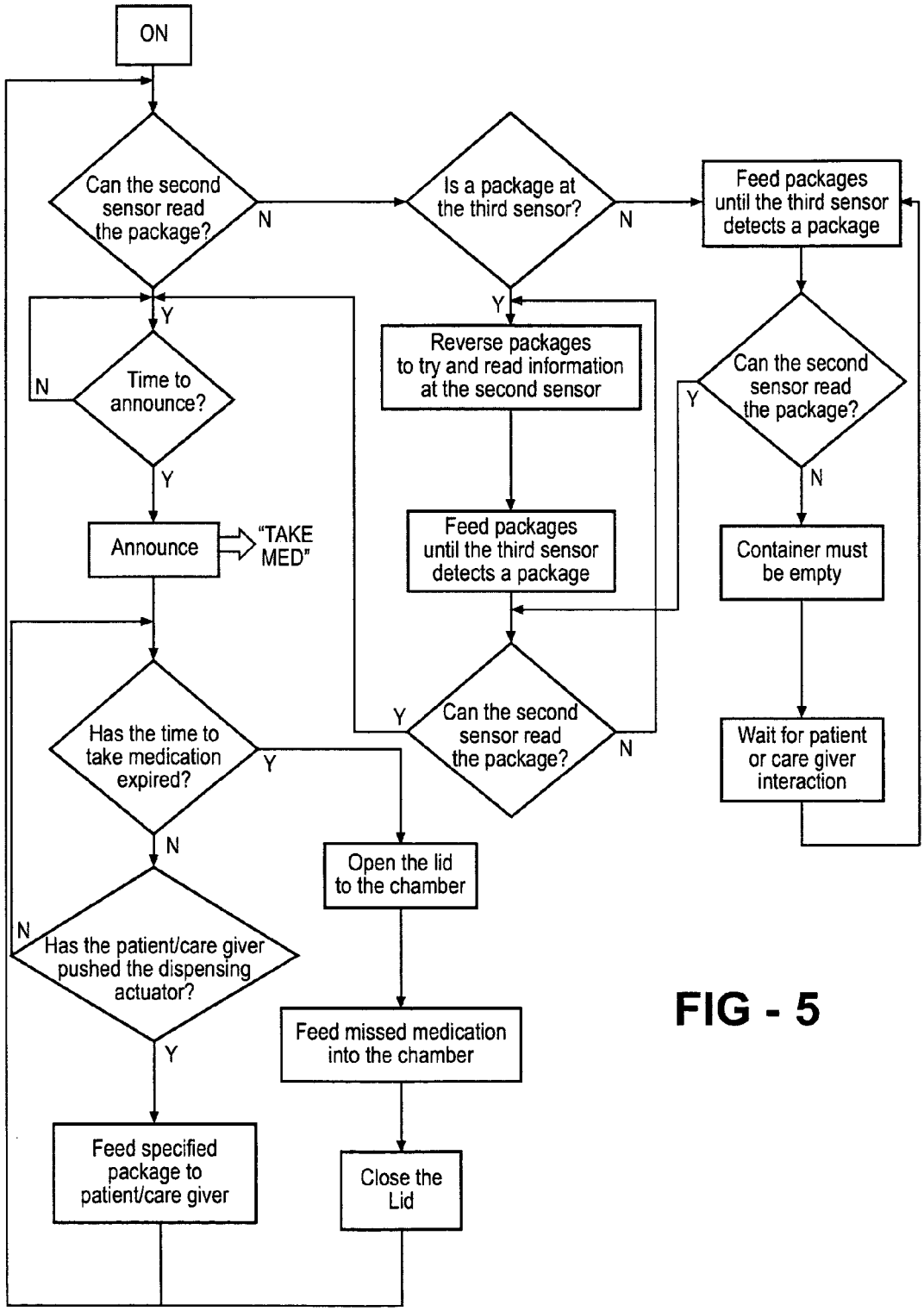
FIG. 5 is a flow diagram showing a presently preferred logic process of the medication dispensing apparatus.

As shown schematically in FIG. 5, when the apparatus 10 is turned on, the reading device 92 communicates with the CPU 52 to make certain the bar code 47, text 49 or other readable information is in a readable position. If the bar code 47, text 49 or otherwise readable information is not in a readable position, the CPU 52 communicates with the motor 48 via the controller 50 to energize the motor 48. The motor then cycles forward and backward until the bar code 47 and/or text 49 is in a readable position. The motor 48 continues to cycle forward and backward for a predetermined, programmed amount of time. If after the time lapses, the bar code 47 and/or text 49 is still not readable, the apparatus 10 will notify the patient and/or caregiver that the packages 12 are either empty, or that a problem exists, as discussed in more detail hereafter. The apparatus may dispense any unreadable packages 12 into the chamber 82, and attempt to read the next available package 12.

Figure 6:
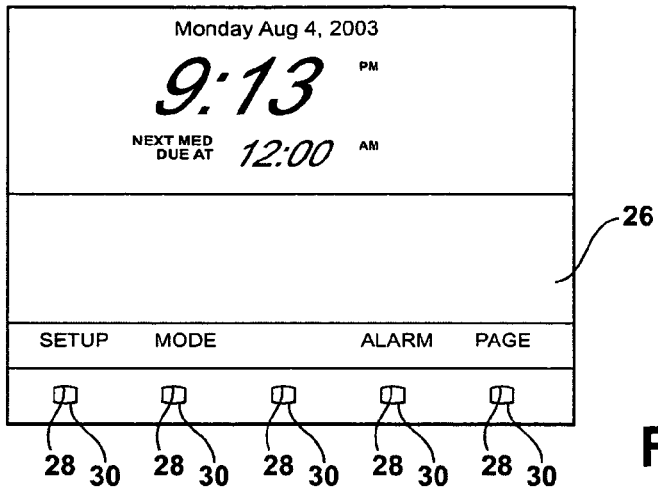
FIG. 6 is a view showing an interface screen of the medication dispensing apparatus in a regular operating mode.

Upon reading the information from the text 49 and/or bar code 47, the CPU 52 communicates with the interface screen 26, as shown in FIG. 6, to visually display the current time, while also displaying the time at which the next dosage of medication is to be taken. At the time the patient is to take their medication, the display panel 26 notifies the user by way of a notification mechanism, for example and without limitation, a flashing signal, such as a flashing bulb 96 (FIGS. 1 and 2) and/or the time on the display panel 26. Additionally, an audible alarm 98 may be programmed to sound by entering a time by depressing the "alarm" key 30 (FIG. 6) so that the user can be alerted while not having visual contact with the display panel 26, let alone the apparatus 10. The audible alarm 98 may take on any variety of forms, for example a buzzer, pre-recorded voice announcement, or the like.

Upon being notified, the user presses the dispensing button 32 to energize the feed mechanism 46. It should be understood that prior to the arrival of the designated interval or window of time for taking a prescribed dosage of medication, the button 32 is de-energized, and therefore, does not actuate the motor 48 to initiate the dispensation of medication from the apparatus when pushed. When the designated window of time to take the medication arrives, the CPU 52 relays a signal to energize the button 32, wherein the button 32 remains energized throughout the designated interval of time. Accordingly, upon pressing the button 32 during the designated window of time for taking a prescribed dosage of medication, the motor 48 is actuated. Accordingly, the prescribed package 12 containing the proper dosage of medications for the specified time interval is fed between the dispensing rollers 72, 74 until the package 12 tears from the remaining packages 12 at the perforated seam 45 located between the feed rollers 58, 60 and the dispensing rollers 72, 74. The package 12 that is separated from the remaining strip of packages 12 is then dispensed through the opening 34 to the user. Otherwise, if the user does not press the dispensing button 32 within the predefined window of time, as discussed above, the CPU 52 relays a signal to de-energize the button 32. Thereafter, the package 12 not dispensed to the user during its designated window of time is dispensed automatically by the feed mechanism 46 into the chamber 82.

Figure 7:
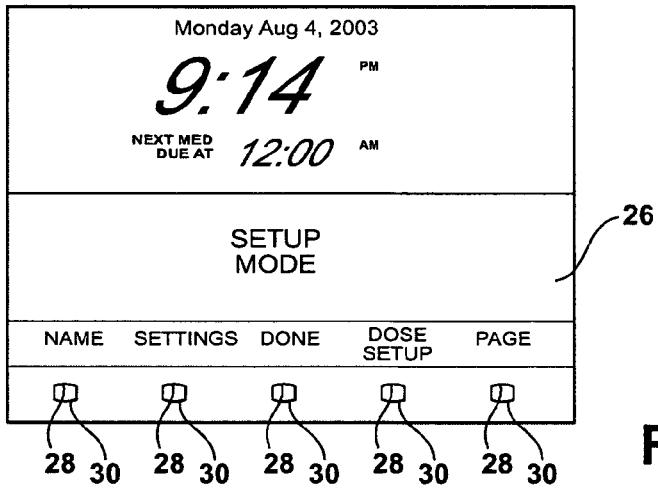
FIG. 7 is a view of the interface screen in a set-up mode.

As shown in FIGS. 6 and 7, the user may program the apparatus 10 by pressing the appropriate keys 30, for example "name", "page" or "alarm" and inputting the desired information. Accordingly, the information may be processed by the CPU 52 where the information is used, at least in part, to notify the patient or caregiver when the specified time arrives to take medication. The notification may take the form of a signal being sent to a pager, phone, email system, or other electronic device, for example a computer or wireless device. The contact information programmed via the keys 30, or otherwise communicated through information on a package 12, into the CPU 52 is communicated to a modem and/or a wireless communication board 100 through an operable connection between the communication board 100 and the CPU 52. Accordingly, when the specified interval of time comes to take medication, the CPU 52 sends a signal to the communication board 100, which in turn sends a signal to the specified communication receiver, be it a pager, phone, email system, or other electronic device, as mentioned above. As a result, the patient or designated caregiver can be further notified that it is time for the patient to take their medication. Aside from the communication board 100 notifying the patient and/or caregiver that it is time to take medication, the communication board can also notify the patient and/or caregiver when the reading device 92 fails to read a package 12. Additionally, the communication board can be programmed to automatically notify the caregiver if the patient fails to take their medication. It should be recognized that the communication board 100 and the CPU 52 could be constructed as a single unit or module, thereby reducing the amount of space required for the single unit, and also improving the efficiency of manufacture and assembly.

Other than the communication board 100 sending a signal to the electronic devices listed above, the patient or caregiver can access the CPU 52 by way of the communication board 100 by dialing-in to the communication board 100. It should be understood that any suitable communication device may be used to dial-in to the communication board, for example phones (cell, cordless, hardwired or otherwise), or computer devices (desktop, PDA, Handheld PC, laptop or otherwise). Accordingly, the patient, caregiver, or other designated party may access saved information in the CPU 52 to obtain information regarding the patient's compliance in taking their medication. As such, the caregiver can be alerted to the patient's noncompliance, should the patient not be taking their medication, thereby providing the caregiver with an opportunity to follow up with the patient before severe complications result from not taking the medication. In addition to accessing information within the CPU 52, the party communicating with the communication board 100 may also send information to the communication board 100, and thus the CPU 52. Accordingly, the party, having a proper authorization code, can program the apparatus 10 to follow immediate or future instructions, for example dispensing medications or alerting the patient or third party to some action.

Figure 8:
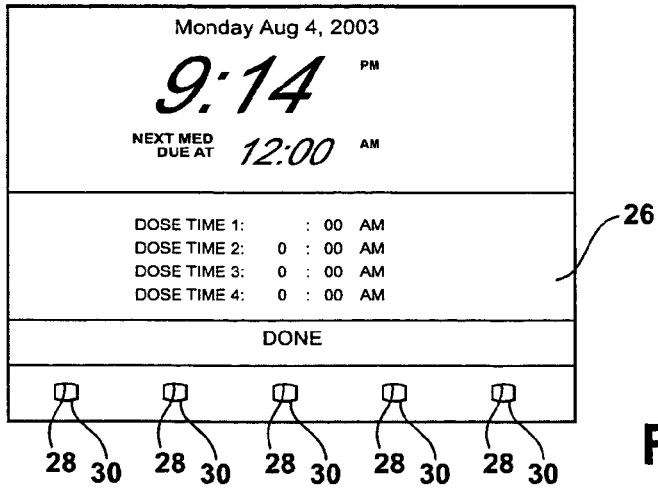
FIG. 8 is a view of the interface screen in a dose programming mode.

Still referring to FIG. 7, the user may manually program the specified times to dispense medication by pressing the "dose setup" key 30. Upon pressing the key 30, the proper times may be input to the CPU 52. If the user inputs entries having equal time increments, the CPU 52 will recognize it, and then cue the user to see if the user wants to select an automatic schedule having the equal time increments between the prescribed times to take the medication. Ultimately, this saves the user from having to manually enter repeated and equally incremented windows of time in which to take medication. As shown in FIG. 8, the dosage times scroll across the interface screen 26 so that the user can be assured of proper time inputs. When the information is entered, the user presses the "done" key 30. It should be recognized that the user need not enter dosage times if the packages 12 have readable text, bar code, or other readable formats including the dosage time information.

The apparatus 10 is generally portable, and as such, the power module 38 preferably has a DC battery backup power source, as well as an AC wall plug connector. Desirably, the batteries are rechargeable, such that they recharge when the apparatus 10 is plugged into a standard 110V outlet. In one presently preferred form, the apparatus 10 is about fifteen inches (15") tall, eight inches (8") wide and fifteen inches (15") deep. It should be recognized, however, that the apparatus 10 may be constructed having smaller or larger dimensions, as desired.

Figure 9:
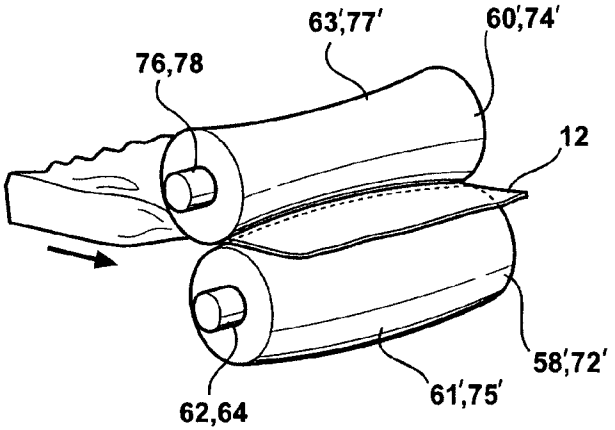
FIG. 9 is a partial perspective view showing another embodiment of a pair of rollers within a feed mechanism of the apparatus.

As best shown in FIG. 9, another presently preferred embodiment of a pair of feed rollers 58', 60', and/or a pair of dispensing rollers 72', 74' is shown. One of the rollers 58', 72' has an outer surface 61', 75', respectively, with a generally symmetrical convex contour, while the other roller 60', 74' has an outer surface 63', 77', respectively, with a generally symmetrical, relatively compliant concave outer surface. Having one of the feed rollers 58' and one of the dispensing rollers 72' with a generally convex outer surface 61', 75', respectively, and the other feed roller 60' and the other dispensing roller 74' with a compliant, and preferably concave outer surface 63', 77', respectively, a uniform and even feeding of the packages 12 between the feed rollers 58', 60' and the dispensing rollers 72', 74' is facilitated. It should be recognized that the outer surfaces 63', 77' may be generally cylindrical in a relaxed state, and take on their generally concave form in response to engagement with the outer surfaces 61', 75', respectively.

Figure 10:
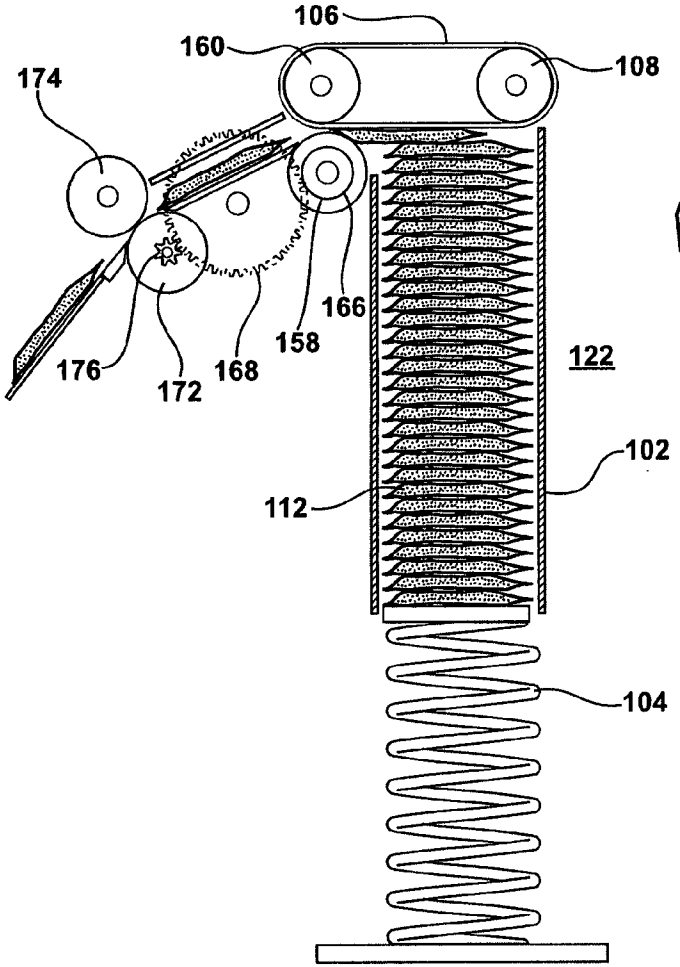

As best shown in FIG. 10, another presently preferred embodiment is shown, wherein similar reference numerals are used to represent similar features as described in the previous embodiment, but are offset by 100. An apparatus 110 (not shown in its entirety) accommodates separate and individual packages 112 of medication for dispensation. The apparatus 110 dispenses the individual packages 112 to a patient or caregiver much as the first embodiment described above, however, instead of the packages 112 being connected to one another along a perforated seam prior to dispensation, the packages are loaded into a magazine or cartridge 102 as separate packages 112. Preferably, the packages 112 are loaded one on top of another with each package 112 arranged in similar fashion to another, and the cartridge 102 is positioned in the cavity 122 of the apparatus 110. The packages 112 are biased upwardly, for example by a spring device 104, to engage a portion of a feed mechanism, represented here as a conveyor belt 106. The conveyor belt 106 is wrapped at least partially around an upper feed roller 160 and an idler roller 108 laterally spaced from the upper feed roller 160. Accordingly, as a lower feed roller 158 is driven by actuation of a motor 148, the upper feed roller 160 is driven, and thus, the conveyor belt 106 is caused to rotate in a clockwise direction. As the conveyor belt 106 rotates, the package 112 in biased contact with the conveyor belt 106 is fed into engagement with the feed rollers 158, 160. Thereafter, the package 112 is fed between the feed rollers 158, 160 and into engagement with the dispensing rollers 172, 174 for dispensation to the patient or caregiver. The package 112 can be of a suitable length to span the distance between the feed rollers 158, 160 and the dispensing rollers 172, 174, thereby causing the packages 112 to engage the dispensing rollers 172, 174 while remaining in contact with the feed rollers 158, 160. Otherwise, if the packages 112 do not span the distance between the feed rollers 158, 160 and the dispensing rollers 172, 174, the packages 112 may be fed by gravity, or some other biasing force, into contact with the dispensing rollers 172, 174. It should be recognized that if the packages 112 do span the distance between the feed rollers 158, 160 and the dispensing rollers 172, 174, the rotational speed of the feed rollers 158, 160 and dispensing rollers 172, 174 may be adjusted through appropriate sizing of the driven gears 166, 176 to prevent the feed rollers 158, 160 and dispensing rollers 172, 174 from fighting one another while engaging the same package 112. Otherwise, the apparatus operates similarly as the first embodiment above, and therefore, is not discussed further.

Figure 11:
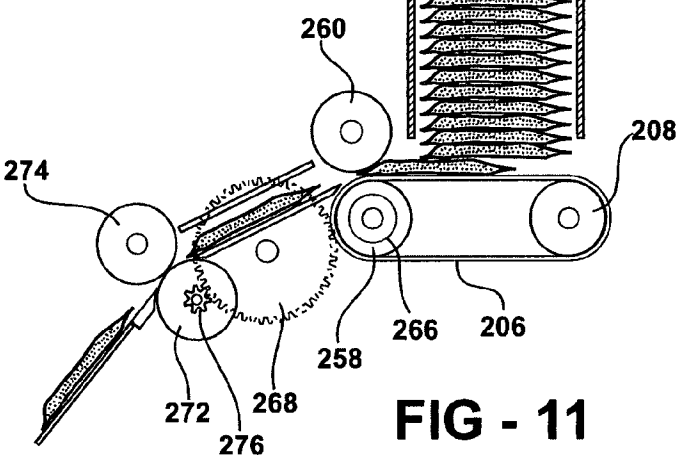
FIGS. 10 and 11 are partial side elevation views showing alternate embodiments of a feed mechanism of the apparatus.

As best shown in FIG. 11, another presently preferred embodiment is shown, wherein similar reference numerals are used to represent similar features as described in the previous embodiments, but are offset by 200. An apparatus 210 (not shown in its entirety) accommodates separate and individual packages 212 of medication much like the previous embodiment. However, unlike the previous embodiment, the packages 212 are located above a conveyor belt 206 and are preferably biased into contact with the conveyor belt 206 by gravity. The conveyor belt 206 is wrapped at least in part around a lower feed roller 258 and an idler roller 208 laterally spaced from the lower feed roller 258. Accordingly, as the lower feed roller 258 is driven through actuation of a motor 248 (not shown), the conveyor belt 206 is caused to rotate in a counterclockwise direction. As the conveyor belt 206 rotates, the package 212 in biased frictional contact with the conveyor belt 206 is fed into engagement with the feed rollers 258, 260. Hereafter, the apparatus 210 operates similarly as the previous embodiments, and therefore, is not discussed further.

Figure 12:
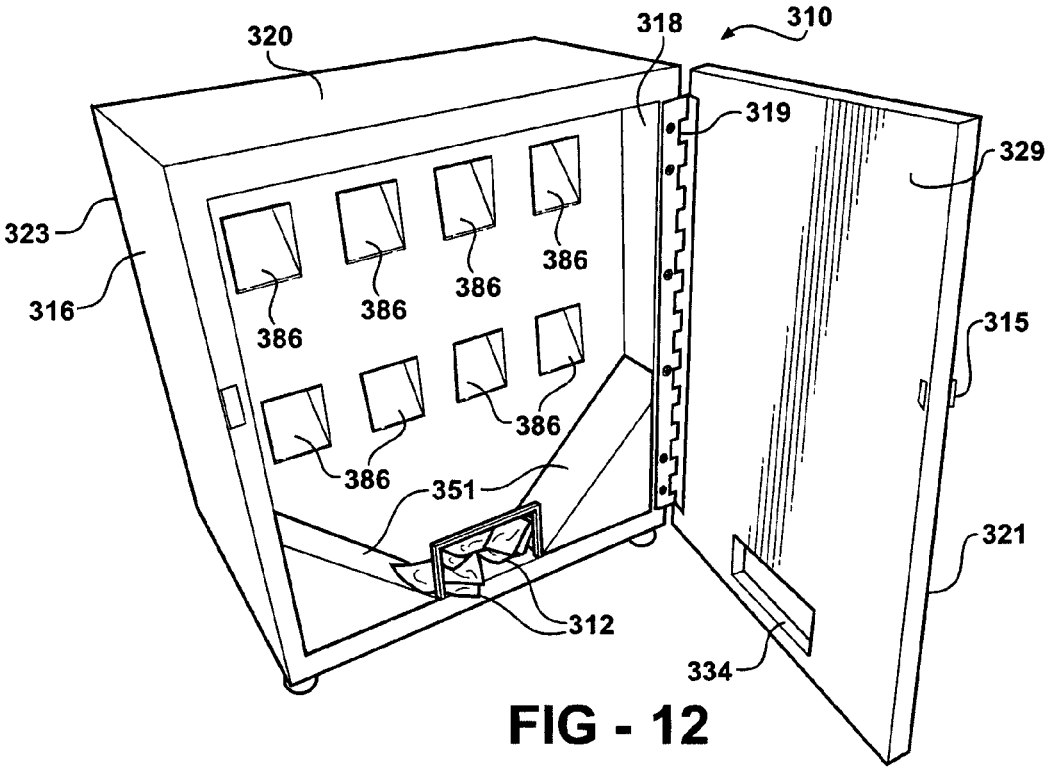
FIG. 12 is a front perspective view of a medication dispensing apparatus constructed according to another embodiment of the invention.
Figure 13:
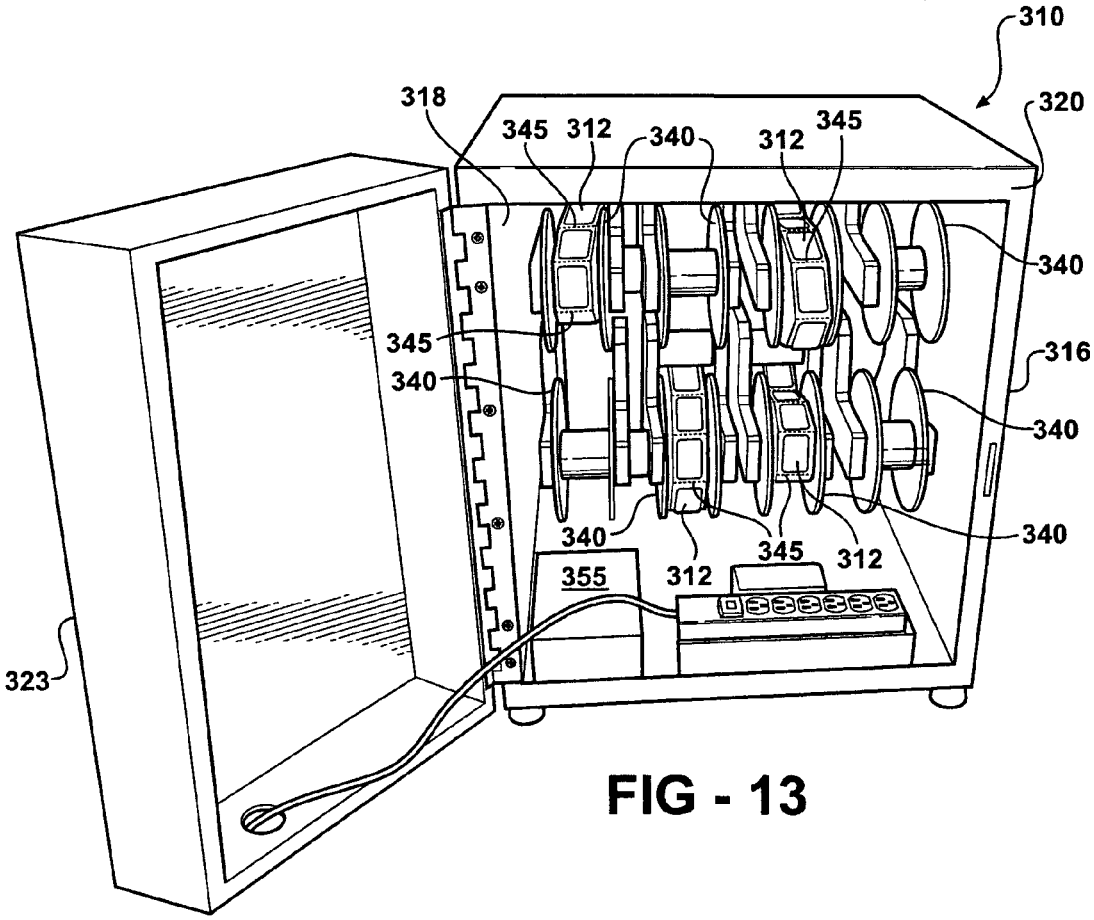
FIG. 13 is a rear perspective view of the medication dispensing apparatus of FIG. 12.

As best shown in FIGS. 12 and 13, an apparatus 310 constructed according to another embodiment of the claimed invention is shown, wherein similar reference numerals offset by 300 are used to represent like features as described in the previous embodiments. The apparatus 310 is constructed to dispense a plurality of packages 312 of prepackaged medications, such as tablets or capsules for example, wherein the packages 312 are arranged as separate strings within a housing 320 of the apparatus 310. Accordingly, each separate string of packages 312 can contain a different type of medication so that the apparatus 310 can be instructed by an authorized user to dispense a plurality of different types and/or quantities of medication, as desired.

The housing 320 has a pair of side walls 316, 318 and a front and rear panel 321, 323, respectively. The front panel 321 is preferably attached to the housing 320 via a plurality of hinges 319 and has at least one opening 334 through which the dispensed packages 312 may be retrieved by an authorized recipient. The hinges 319 allow the front panel 321 to be opened for access into the housing 320, such as may be desired to service the apparatus 310. To prevent unauthorized access into the housing 320, preferably a lock 315, such as a key actuated lock or electromechanical lock, for example, is arranged for operable communication with the front panel 321 to prevent unauthorized entry by anyone other than those having the proper key, access code, or the like, depending on the type of lock incorporated.

Figure 14:
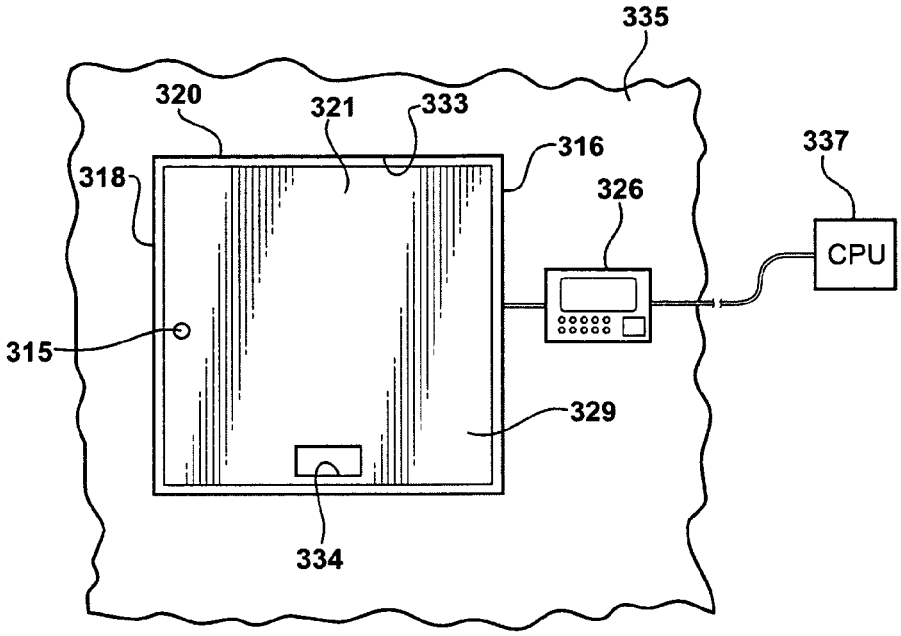
FIG. 14 is a front elevation view of the medication dispensing apparatus of FIG. 12 mounted in a wall with an interface device and a central processing unit communicating therewith.
Figure 15:
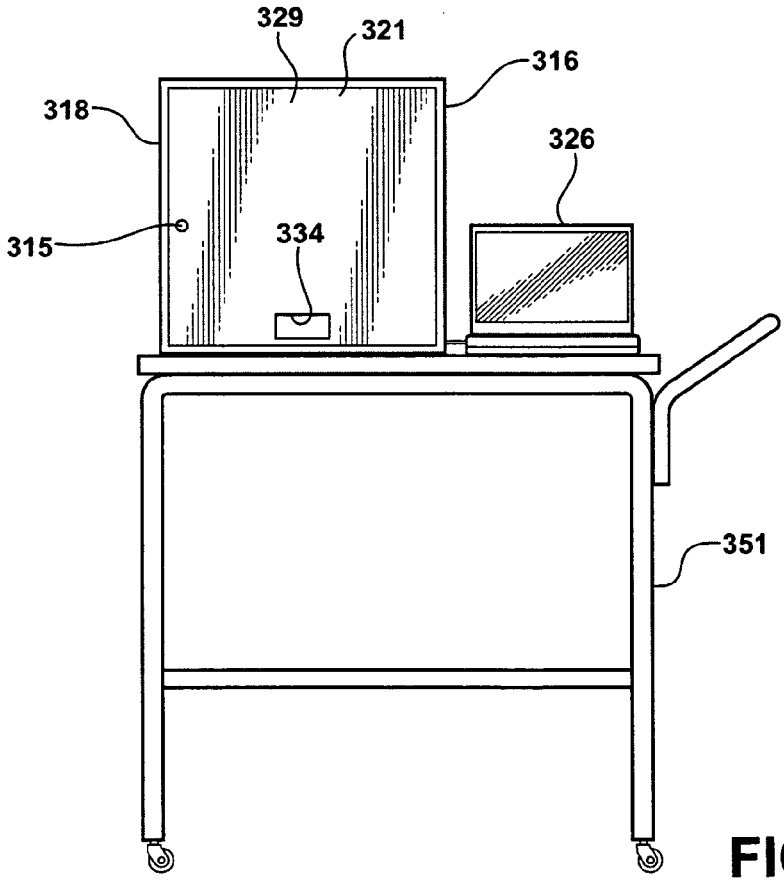
FIG. 15 is an elevation view of the apparatus of FIG. 12 communicating with an interface device on a mobile cart.

In addition to the lock 315, to prevent unauthorized or undesired viewing into the apparatus 310 through the front panel 321, desirably the front panel 321 has a two way vision system, such as a two way mirror 329, for example. As such, anyone looking toward the front panel 321 can not see beyond the front panel 321 into the apparatus 310 without first having demonstrated in some manner that they are an authorized person, such as by entering an access code into an interface device 326 (FIGS. 14 and 15). Upon demonstrating proper authorization, preferably a light 331 behind and generally adjacent the front panel 321 is illuminated to provide temporary viewing through the front panel 321. Accordingly, the medication being dispensed can be temporarily viewed as it falls toward the opening 334 in the front panel 321, and further, if a problem arises within the apparatus 310 during the dispensing process, such as one of the packages 312 of medication being stuck within the apparatus 310, for example, the problem can be readily seen.

Figure 17:
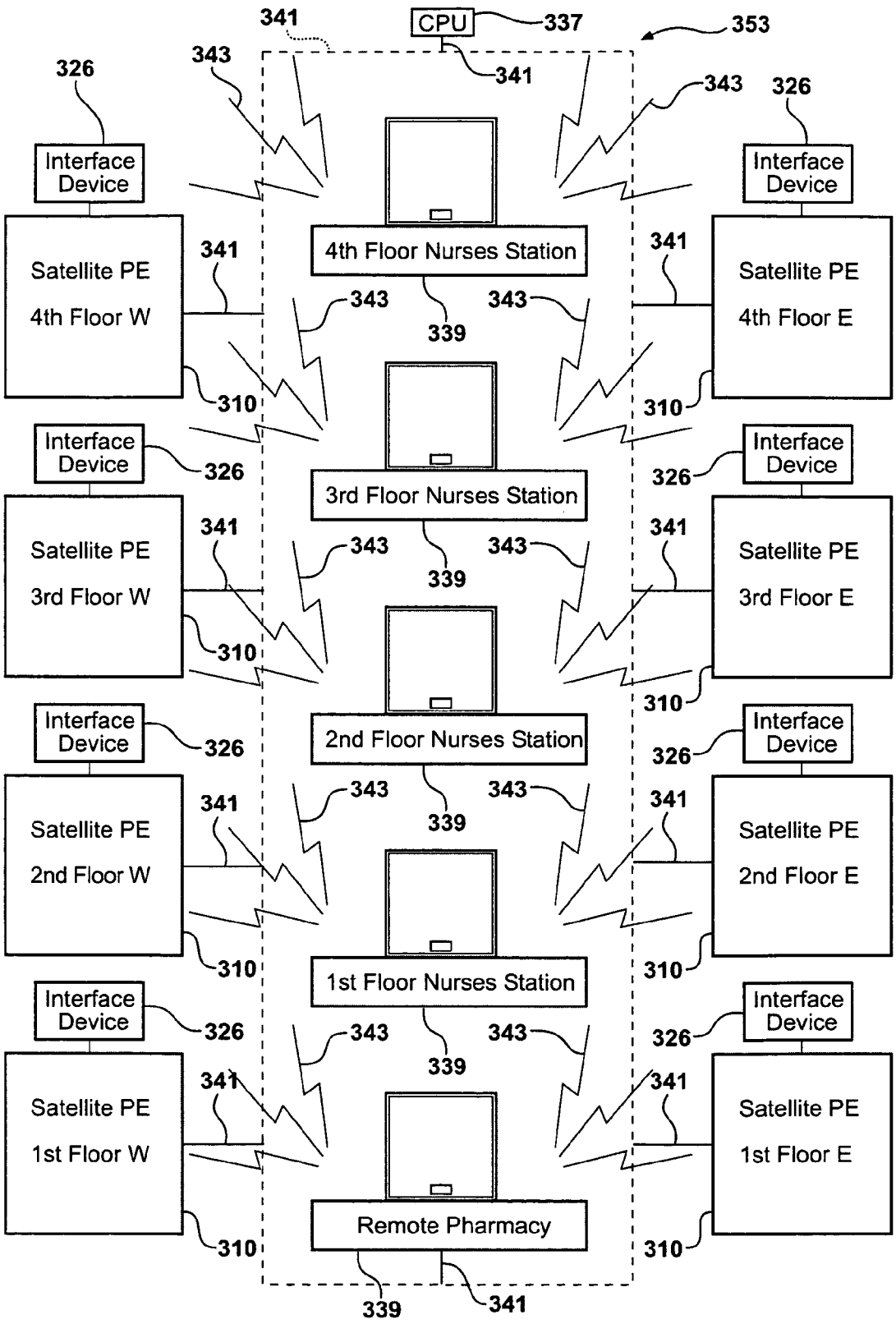
FIG. 17 is a block diagram showing one embodiment of a communication network between a plurality of medication dispensing apparatus of FIG. 12 and a plurality of remote stations.

As shown in FIG. 14, desirably the apparatus 310 can be mounted in an opening 333 of a wall 335 to provide a localized dispensing station for the packages 312 of prepackaged medication. As many units as desired may be placed side-by-side to increase the number and variety of packages 312 that can be dispensed at any one location. As shown in FIG. 14, when the apparatus is mounted within the wall 335, desirably the interface device 326, such as a key pad and monitor, for example, is in communication with the apparatus 310 and a central processing unit 337 (CPU). As illustrated in FIG. 17, the (CPU) 337 is generally in operable communication with at least one control station and represented here as a plurality of control stations 339, such as a nurses station and/or a pharmacist's station, for example. The communication between each of the interface devices 326, apparatus 310, CPU 337, and the control stations 339 can be through an Ethernet system, virtual private network (VPN), or Internet system, for example, and can be through a wireless connection, such as by way of an RF signal, for example, or a hard wired connection.

Additionally, as shown in FIG. 15, the apparatus 310 can be transported as a mobile medication dispensing station, such as on a mobile wheeled hospital cart 351, for example. Desirably, when arranged as a mobile dispensing station, the apparatus 310 is powered via a backup battery power source 338 (FIG. 16), preferably carried in the housing 320 of the apparatus 310 and communicates with at least one station 339 via the interface device 326, such as a lap top computer, a palm device, or the like, and also the CPU 337. It should be recognized that the mobile interface device 326 may be adapted for a hard wired connection to an outlet or phone jack (not shown), for example, and also could be arranged for communication via a modem, for example.

Figure 16:
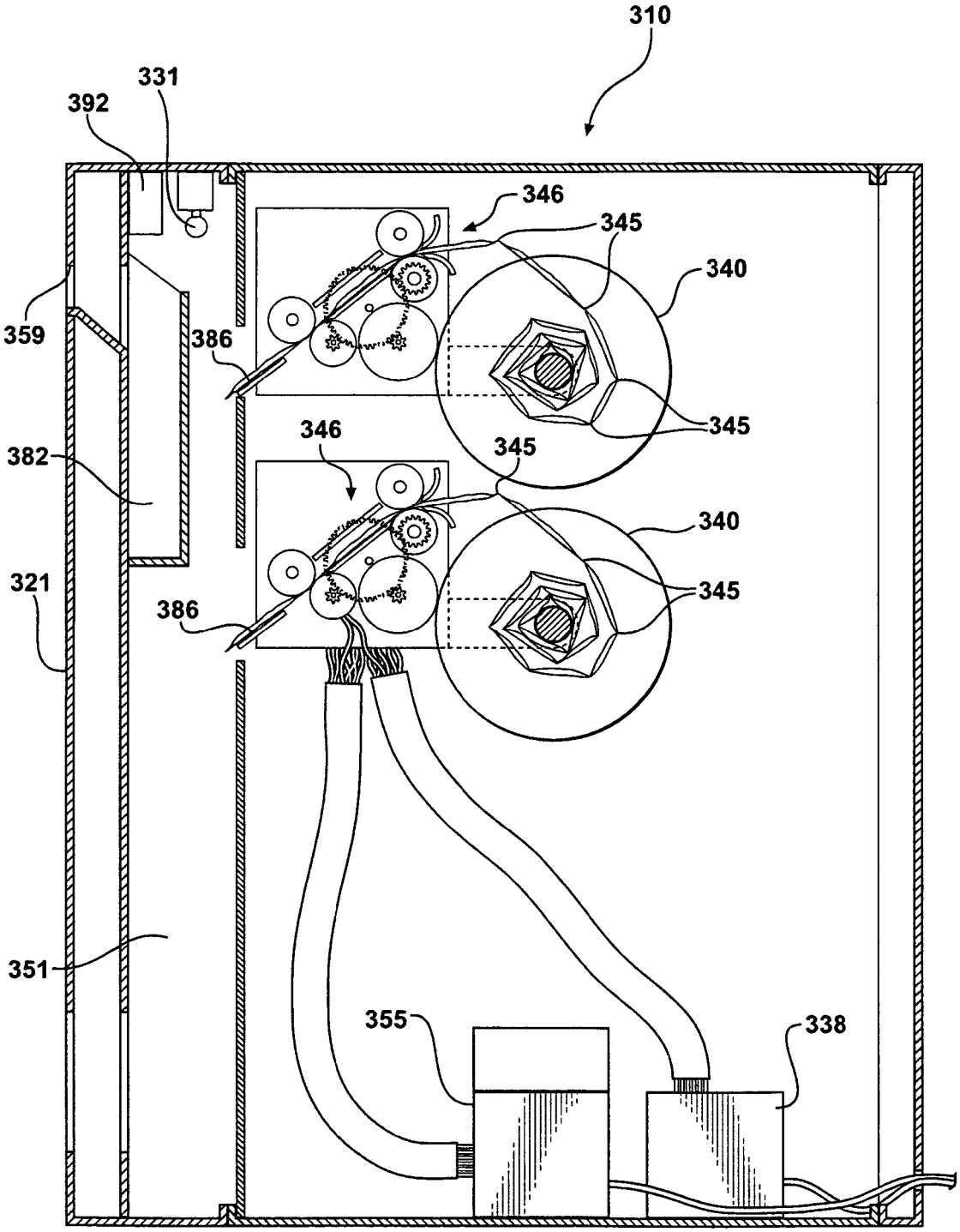
FIG. 16 is schematic internal side view of the medication dispensing apparatus of FIG. 12 showing a plurality of feed mechanisms communicating with a plurality of prepackaged doses of medication.

As shown in FIGS. 12 and 16, the apparatus 310 has a plurality of dispensing chutes 386, shown here by example and without limitation as having eight chutes 386, with each chute 386 communicating with a separate feed mechanism 346 and a separate string of packages 312. The feed mechanisms 346 and their operation are the same as described above in the previous embodiments, and thus, are not discussed in further detail.

Each string of packages 312 is desirably received in a separate housing container or coiled about a housing, represented here as a spool 340, wherein the spools 340 are sized to receive the desired shape and size of the packages 312. Desirably, the spools 340 are sized to accommodate a plurality of packages 312 of medication preferably attached to one another along a perforated seam 345, as in the embodiments above. Preferably, anywhere from a 1 day supply or more of prepackaged medications are received about the spools 340, generally depending on the type of medication within the packages 312 and the demand for the particular type of medication within the packages 312. Though the packages 312 are shown coiled about the spools 340, it should be recognized that the packages 312 could be arranged in a folded accordion manner, or as separate packages, as discussed in the previous embodiments.

The chutes 386 are desirably spaced inwardly from the front panel 321 to allow the dispensed packages 312 of medication to exit the chutes 386 and fall generally toward the opening 334 in the front panel 321. To facilitate directing the dispensed packages 312 toward the opening 334, preferably a pair of inclined ramps 351 (FIG. 12) extend from the sides 316, 318 of the apparatus 310 and converge inwardly toward the opening 334 in the front panel 321 to funnel or channel the dispensed packages 312 toward the opening 334. Though shown as having a single opening 334, it should be recognized that separate openings could be incorporated in the front panel for direct communication with each chute 386, thereby eliminating the need for the ramps 351 to direct the packages 312 toward the single opening 334, though not shown here.

As shown schematically in FIG. 17, a plurality of apparatus 310 are desirably in communication with one another via a network 353. Though a single network 353 is shown here, it should be recognized that a plurality of networks may be arranged in communication with one another. The communication between networks 353, the apparatus 310, the nurses stations 339 and the pharmacist's station 339 may be through a hard wire connection or wireless communication, such as in the form of an Ethernet, VPN, global area network (GAN), local area network (LAN), wide area network (WAN), Internet or radio frequency (RF) communication, for example. Desirably, each apparatus 312 has a serial controller 355 (FIG. 13) in communication with the CPU 337, wherein the CPU 337 is in communication with at least one station and preferably all of the nurse stations 339 and the pharmacist's station 339, for example. Provided that the user has demonstrated proper credentials or has authorization to issue the dispensing instructions, the user can send instructions from either of the nurse stations 339 and/or the pharmacist's station 339 to dispense packages 312 of medication from a selected one or more of the apparatus 310. Preferably, the user inputs an access code at one of the stations 339 in order to send instructions to the respective apparatus 310 to dispense one or more packages 312 of medication. It should be recognized that the authorized user could input the instructions to dispense medication directly in the interface device 326 at the respective apparatus 310. Upon entering instructions to dispense medication from the station 339, the CPU 337 processes and channels the instructions to the respective serial controller 355, whereupon the serial controller 355 sends a signal to the respective feed mechanism 346 to dispense the proper package 312 of medication to an authorized recipient.

The CPU 337 is preferably programmed with specific information pertaining to the medication contained within each apparatus 310 linked to the associated network 353. For example, the programmed information may include the number of packages 312 currently available to each feed mechanism 346 in each apparatus 310, the types of medication within each package 312, the dosage of each medication within each package 312, the expiration date of each medication within each package 312, the potential drug interactions between medications within each package 312, or any other information, as desired. Accordingly, the CPU 337 can be programmed to send a notification to a selected station 339 or authorized user when a condition arises, such as low numbers of remaining packages 312, potential drug interactions, expiration information for the medication within the individual packages 312, and the like.

In use, a user may enter a request for medication to be dispensed from one of the apparatus 310 by entering the request directly into the interface device 326 of the apparatus 310, or otherwise entering the instructions to the CPU 337 on the network 353. Otherwise, it should be recognized that the request for medications to be dispensed from a chosen apparatus 310 can be entered from any interface device 326 in communication with the network 353, whether the channel of communication be hard wired or wireless. Upon the request being entered, the request is processed, such as by a pharmacist, wherein the pharmacist can send dispensing instructions to have the requested medication dispensed from the specified apparatus 310. The request and the dispensing instructions are processed by the CPU 337 so that any necessary information, such as medication supplies or shortages at the respective apparatus 310, for example, may be immediately communicated to the users awaiting the medication. If a specified apparatus 310 is out of the requested medication, then the user may be directed to the next nearest apparatus 310 for the requested medication. It should also be recognized that a request may be for several different types of medication, and that a single apparatus may fill the request for multiple types of medication by having the different medications dispensed from different spools 340 within the apparatus 310. It should also be recognized that a user may have medication dispensed from a selected apparatus 310 without the assistance of a pharmacist if the user demonstrates proper authorization.

As shown in FIG. 16, if the apparatus 310 dispenses an improper type of medication, for what ever reason, the recipient may deposit the package 312 of medication back into the apparatus 310 through a return slot 359, preferably located in the front panel 321. Desirably, the package 312 is reentered into the inventory of the apparatus 310 through communication with the CPU 337. To facilitate the communication to the CPU 337 regarding the returned package 312, preferably the package 312 has coded information thereon, such a bar code 347 with the enclosed medication information, such a type and quantity, for example. It should be recognized that the information may include the content and be in the form as detailed in the previous embodiments, such as Braille, for example. The apparatus 310 preferably has a bar code scanner 392 adjacent the return slot 359 and in communication with the CPU 337, such that the bar code scanner 392 scans the packages 312 returned through the slot 359 and communicates the information to the CPU 337. It should be recognized that the apparatus 310 could also have a bar code scanner positioned to scan the packages 312 as they are dispensed, thereby communicating the information on the bar code to the CPU 337, as discussed in the previous embodiments. The returned medication can be maintained within a quarantine or holding area 382 until an authorized user gains access to the holding area 382 to retrieve the package 312. Upon retrieving the package 312, the user may return the package to the pharmacist for proper disposal and/or inventory tracking.

The disclosed embodiments are representative of presently preferred constructions of the invention, but are intended to be illustrative rather than limiting thereof. For example, it should be recognized that the gears may be replaced with sprockets and chains, pulleys and belts, or any other suitable drive linkage. One ordinarily skilled in the art will recognize other embodiments upon viewing this disclosure in its entirety. It should be understood that other embodiments of the invention which accomplish the same or similar functions are incorporated herein within the scope of the claims.

We claim:

1. An apparatus for dispensing packages of medication, comprising:

a plurality of separate bodies each having an internal cavity and an outlet;

an actuator received in each of said cavities;

a separate feed mechanism received in each of said cavities, each said feed mechanism being arranged in operable communication with an associated one of said actuators, each of said feed mechanism having a first pair of elongate feed rollers with outer surfaces spanning the width of the packages and terminating at opposite ends, said feed rollers being arranged to simultaneously engage a common one of the packages on opposite sides of the package and to engage one another in the absence of the packages therebetween, one of said outer surfaces having a convex contour extending between its opposite ends, the other of said outer surfaces being substantially cylindrical and compliant and conforming with said convex contour of said one outer surface; and a processing unit in operable communication with each of said actuators to regulate the dispensation of the packages by said feed mechanisms through each outlet.

2. The apparatus of claim 1 wherein each feed mechanism further comprises a second pair of dispensing rollers arranged to simultaneously engage a common one of the packages on opposite sides of the package as the package passes between said pair of dispensing rollers and to engage one another in the absence of the packages therebetween.

3. The apparatus of claim 2 wherein one feed roller in each of said pair of feed rollers has a driven member and one dispensing roller in each of said pair of dispensing rollers has a driven member and each of said actuators has a drive member, each of said driven members being arranged in operable communication with an associated one of said drive members causing said one feed roller and said one dispensing roller to rotate in response to rotational movement of said associated one of said drive members.

4. The apparatus of claim 2 wherein one dispensing roller in each of said pair of dispensing rollers rotates at a greater velocity than one feed roller in each of said pair of feed rollers in response to rotational movement of said actuators.

5. The apparatus of claim 2 wherein one feed roller in each of said pair of feed rollers and one dispensing roller in each of said pair of dispensing rollers are laterally spaced a first distance from one another and the other of said feed rollers in each of said pair of feed rollers and the other of said dispensing rollers in each of said pair of dispensing rollers are laterally spaced a second distance from one another, said second distance being greater than said first distance.

6. The apparatus of claim 1 wherein a plurality of feed mechanisms are received in each of said bodies.

7. The apparatus of claim 6 wherein each of said feed mechanisms is arranged to receive a separate string of the packages attached to one another along a perforated seam.

8. The apparatus of claim 7 wherein said feed mechanisms feed the separate strings of packages independently of one another.

9. The apparatus of claim 8 wherein said feed mechanisms can feed separate packages at the same time.

10. The apparatus of claim 1 wherein the apparatus receives instructions to dispense packages from the apparatus from a station remote to the apparatus.

11. A method of dispensing packages of medication to an authorized recipient, comprising the steps of:

providing a plurality of medication dispensing apparatus each having a feed mechanism;

forming a network by arranging said medication dispensing apparatus in communication with one another;

incorporating a processing unit in said network;

incorporating an interface device in communication with said processing unit;

providing packages containing predetermined doses medication;

loading said packages into said medication dispensing apparatus;

entering a request for medication into the interface device;

processing the request for medication though the processing unit and making a package from a selected medication dispensing apparatus accessible to the recipient by engaging opposite sides of said package with said feed mechanism and dispensing said package to the recipient; and further including providing said feed mechanism having a pair of elongate first feed rollers with outer surfaces spanning the width of the packages and terminating at opposite ends with one of said outer surfaces having a convex contour extending between its opposite ends and the other of said outer surfaces being compliant and conforming with said convex contour, and arranging said first feed rollers to simultaneously engage a common one of the packages on opposite sides of the package and to engage one another in the absence of the packages therebetween.

12. The method of claim 11 including providing said packages as separate strings of packages attached to one another along a perforated seam.

13. The method of claim 12 wherein said feed mechanism is operable to separate a selected one or more of said packages from an associate one of said string of packages.

14. The method of claim 13 including providing each of said medication dispensing apparatus with a plurality of feed mechanisms, each of said feed mechanisms being operable independently from one another to dispense a different medication.

15. An apparatus for dispensing packages of medication, comprising:

a body having an internal cavity and an outlet;

an actuator received in said internal cavity; and a feed mechanism having a pair of elongate first rollers with outer surfaces substantially spanning the width of the packages and terminating at opposite ends, said first rollers being arranged to simultaneously engage a common one of the packages on opposite sides of the package and to engage one another in the absence of the packages therebetween, one of said first rollers being constructed from one material having a convex outer surface extending between its opposite ends, the other of said first rollers being constructed from a different material than said one material and having a compliant outer surface conforming with said convex outer surface upon confronting said convex outer surface to take on a concave contour, said feed mechanism being received in said cavity and being in operable communication with said actuator and engaging opposite sides of said packages for feeding and dispensing the packages of medication toward said outlet.

16. The apparatus of claim 15 wherein said other of said first rollers has a compliant cylindrical outer surface.

17. The apparatus of claim 16 further comprising a pair of elongate second rollers downstream of said first rollers, said second rollers being arranged to simultaneously engage a common one of the packages on opposite sides of the package and to engage one another in the absence of the packages therebetween, one of said second rollers having a convex outer surface and the other of said second rollers having a compliant outer surface conforming with said convex outer surface of said one second roller to take on a concave contour.

18. The apparatus of claim 17 wherein said other of said second rollers is substantially cylindrical.

* * * * *